US008657124B2

(12) United States Patent
Brown

(10) Patent No.: US 8,657,124 B2
(45) Date of Patent: Feb. 25, 2014

(54) SHOE HANGING RACK SYSTEM

(76) Inventor: Shatikwa Brown, Brooklyn, NY (US)

( * ) Notice: Subject to any disclaimer, the term of this patent is extended or adjusted under 35 U.S.C. 154(b) by 129 days.

(21) Appl. No.: 12/871,741

(22) Filed: Aug. 30, 2010

(65) Prior Publication Data

US 2012/0048816 A1 Mar. 1, 2012

(51) Int. Cl.

| | |
|---|---|
| ***A47F 7/08*** | (2006.01) |
| ***A47G 29/00*** | (2006.01) |
| ***F16B 2/02*** | (2006.01) |

(52) U.S. Cl.

USPC ..... 211/34; 211/85.3; 211/113; 211/119.004

(58) Field of Classification Search

USPC ..... 211/34, 113, 85.3, 35, 38.118, 119.004, 211/119.009, 106.01; 383/119, 97, 42; 206/387, 290, 292, 293; 223/98

See application file for complete search history.

(56) References Cited

U.S. PATENT DOCUMENTS

| | | | | | |
|---|---|---|---|---|---|
| 1,984,827 | A | * | 12/1934 | Derman | 312/4 |
| 2,077,458 | A | * | 4/1937 | Chesnut, Jr. | 206/294 |
| 2,110,232 | A | * | 3/1938 | Moore et al. | 211/35 |
| 2,179,771 | A | * | 11/1939 | Wienand | 211/85.3 |
| 2,359,372 | A | * | 10/1944 | Leader | 383/39 |
| 2,598,614 | A | * | 5/1952 | Gilbert | 211/113 |
| 2,646,195 | A | * | 7/1953 | Kleist | 223/88 |
| 2,767,895 | A | * | 10/1956 | Smith | 224/275 |
| 2,866,559 | A | * | 12/1958 | Byrne | 211/35 |
| 3,002,639 | A | | 3/1960 | Cavanagh | |
| 2,941,672 | A | * | 6/1960 | Lathrop | 211/85.3 |
| 3,210,787 | A | * | 10/1965 | Allsop | 12/120.5 |
| 3,308,959 | A | * | 3/1967 | Repair | 211/85.3 |
| 3,642,143 | A | * | 2/1972 | Cass | 211/85.3 |
| 3,705,653 | A | * | 12/1972 | Pereyra | 211/85.3 |
| 3,913,745 | A | | 10/1975 | Weiss | |
| 3,967,666 | A | * | 7/1976 | Farrar | 383/7 |
| 4,730,942 | A | * | 3/1988 | Fulcher | 383/7 |
| 4,736,854 | A | * | 4/1988 | King et al. | 211/85.3 |
| 4,738,547 | A | * | 4/1988 | Brown | 383/39 |
| 4,749,088 | A | * | 6/1988 | Workman et al. | 211/13.1 |
| 4,874,100 | A | * | 10/1989 | Smagula | 211/60.1 |
| 4,953,765 | A | * | 9/1990 | Little et al. | 224/583 |
| D315,839 | S | * | 4/1991 | Martorella | D6/513 |
| 5,031,777 | A | * | 7/1991 | Knox | 211/85.3 |
| 5,076,442 | A | | 12/1991 | Hakeem | |
| 5,137,149 | A | * | 8/1992 | Polacek | 206/278 |
| 5,259,497 | A | * | 11/1993 | Brothers et al. | 206/6.1 |
| 5,294,007 | A | | 3/1994 | Edmondson | |
| 5,337,907 | A | * | 8/1994 | McKenzie et al. | 211/88.01 |
| 5,370,246 | A | * | 12/1994 | Traynor | 211/86.01 |
| 5,743,649 | A | * | 4/1998 | Gonzalez | 383/6 |
| 5,779,033 | A | * | 7/1998 | Roegner | 206/6.1 |
| 5,845,780 | A | * | 12/1998 | Allen | 206/579 |
| 5,894,940 | A | | 4/1999 | Gusdorf et al. | |
| D417,556 | S | | 12/1999 | Schell | |
| 6,126,021 | A | * | 10/2000 | Wilhite | 211/119.004 |
| 6,193,034 | B1 | * | 2/2001 | Fournier | 190/107 |
| 6,250,470 | B1 | * | 6/2001 | Mackenzie | 206/579 |
| 7,117,619 | B1 | * | 10/2006 | Huber | 40/495 |
| 7,328,780 | B2 | * | 2/2008 | Hawthorne | 190/107 |

(Continued)

*Primary Examiner* — Jennifer E Novosad

(74) *Attorney, Agent, or Firm* — Dwayne L. Bentley; DL Bentley Law Group PLLC

(57) ABSTRACT

A shoe hanging system is provided. The system includes a frame, where the frame is encapsulated by a cover. The cover is firmly attached to a spine. The spine is attached to a holding device, where the holding device is configured to hold at least one shoe.

10 Claims, 9 Drawing Sheets

(56) References Cited

U.S. PATENT DOCUMENTS

| | | | | |
|---|---|---|---|---|
| 7,562,408 | B1 * | 7/2009 | Johnson et al. | 5/658 |
| 7,645,189 | B2 | 1/2010 | Pilger | |
| 7,712,641 | B2 * | 5/2010 | Snyder | 223/88 |
| 7,748,584 | B2 * | 7/2010 | Easom | 224/401 |
| 7,946,434 | B1 * | 5/2011 | Greenspon | 211/85.3 |
| D665,203 | S * | 8/2012 | Carr et al. | D6/514 |
| 8,348,054 | B2 * | 1/2013 | Dragan | 206/292 |
| 2002/0074199 | A1 * | 6/2002 | Albritton | 190/107 |
| 2004/0005100 | A1 * | 1/2004 | Versluys | 383/119 |
| 2004/0050638 | A1 * | 3/2004 | Rodrigue et al. | 190/107 |
| 2004/0129659 | A1 * | 7/2004 | Lam | 211/85.3 |
| 2005/0074187 | A1 * | 4/2005 | Sabounjian | 383/38 |
| 2005/0232519 | A1 * | 10/2005 | Grimes, Jr. | 383/39 |
| 2007/0251895 | A1 | 11/2007 | Griffin | |
| 2008/0056625 | A1 * | 3/2008 | Stanton et al. | 383/104 |
| 2009/0057250 | A1 * | 3/2009 | Turner et al. | 211/85.3 |
| 2009/0200252 | A1 * | 8/2009 | Blitz et al. | 211/85.3 |
| 2010/0276241 | A1 * | 11/2010 | Malone | 190/9 |
| 2011/0042335 | A1 * | 2/2011 | McNicholas | 211/85.3 |

* cited by examiner

SHOE HANGING RACK SYSTEM

FIELD OF THE INVENTION

The present invention relates to a system for hanging shoes on a structure.

BACKGROUND OF THE INVENTION

Generally, in any apartment or house people keep their clothes, shoes and other essential items in closets, cabinets etc. In some instances, people are not able to retain their clothes and shoes because of the lack of space at their apartment or house so they store their clothes and shoes at a storage facility or get rid of them. In order to retain the clothes and shoes at their residence they need to have an efficient way of packing away their clothes and shoes into the closets, cabinets etc. In some instances the apartments and houses with closets may be too small to retain all the clothes and shoes a person has in their possession. Also, there are some apartments and houses that simply don't have enough closets to keep all the clothes and shoes a person may have.

If the person wants to keep his clothes and shoes, she may come up with specific methods for efficiently retaining her clothes and/or shoes. One of these methods is to obtain a shoe rack or shoe holder system. These shoe rack or shoe holder system are designed to suspend from the closet clothes rod or door, for example the rack disclosed in U.S. Pat. No. 3,913,745 to Weiss, but this device may cause problems with the clothes in the hanging area. Another method is to use a display clip from U.S. Pat. No. 3,002,629 that is able to hold a shoe for display in a store but may not be desirable to use at home. Yet another shoe rack organizational system is U.S. Pat. No. 5,076,442 that is a complex construction designed to mount in a closet. Another shoe rack system is U.S. Pat. No. 5,894,940 that is a complicated interchangeable wire rack system secured and suspended between side runners.

All of the aforementioned shoe organizing systems have a myriad of problems. First, they are not desirable to be used in the home, they don't protect shoes from being damage while the shoe is on the rack, they don't allow shoes, particularly boots, to maintain their shape and they don't provide the user with easy access to insert or remove the shoe from the shoe rack system. Therefore, there is a need for an easily accessible shoe rack system that is simple for a user to insert a shoe onto that protects the shoe and the user is able to effortlessly retain and access the shoe.

SUMMARY OF THE INVENTION

The present invention has been accomplished in view of the above-mentioned technical background, and it is an object of the present invention to provide a system and method for hanging shoes, in particular boots.

In a preferred embodiment of the invention, a shoe hanging system is provided. The system includes a frame, where the frame is encapsulated by a cover, where the cover is firmly attached to a spine. The spine is attached to series of holding devices, where each holding device is configured to hold at least one shoe.

In another preferred embodiment of the invention, a shoe hanging device is provided, which includes a frame connected to at least two spines, where the spines include at least two covers, where the at least two covers encapsulates the spines, the first spine includes a flap, where the flap is attached to a first holding device, where the first holding device is configured to receive at least one shoe. The second spine includes a flap, wherein the flap is attached to a second holding device, where the second holding device is configured to receive at least one shoe.

In yet another preferred embodiment of the invention, a shoe hanging device is disclosed, which includes a frame encapsulated by a cover. A spine is attached to the cover, where the spine has a flap. The flap is attached to a holding device configured to receive at least one shoe.

BRIEF DESCRIPTION OF THE DRAWINGS

These and other advantages of the present invention will become more apparent as the following description is read in conjunction with the accompanying drawings, wherein.

DETAILED DESCRIPTION OF THE INVENTION

The presently preferred embodiments of the invention are described with reference to the drawings, where like components are identified with the same numerals. The descriptions of the preferred embodiments are exemplary and are not intended to limit the scope of the invention.

Figure 1:
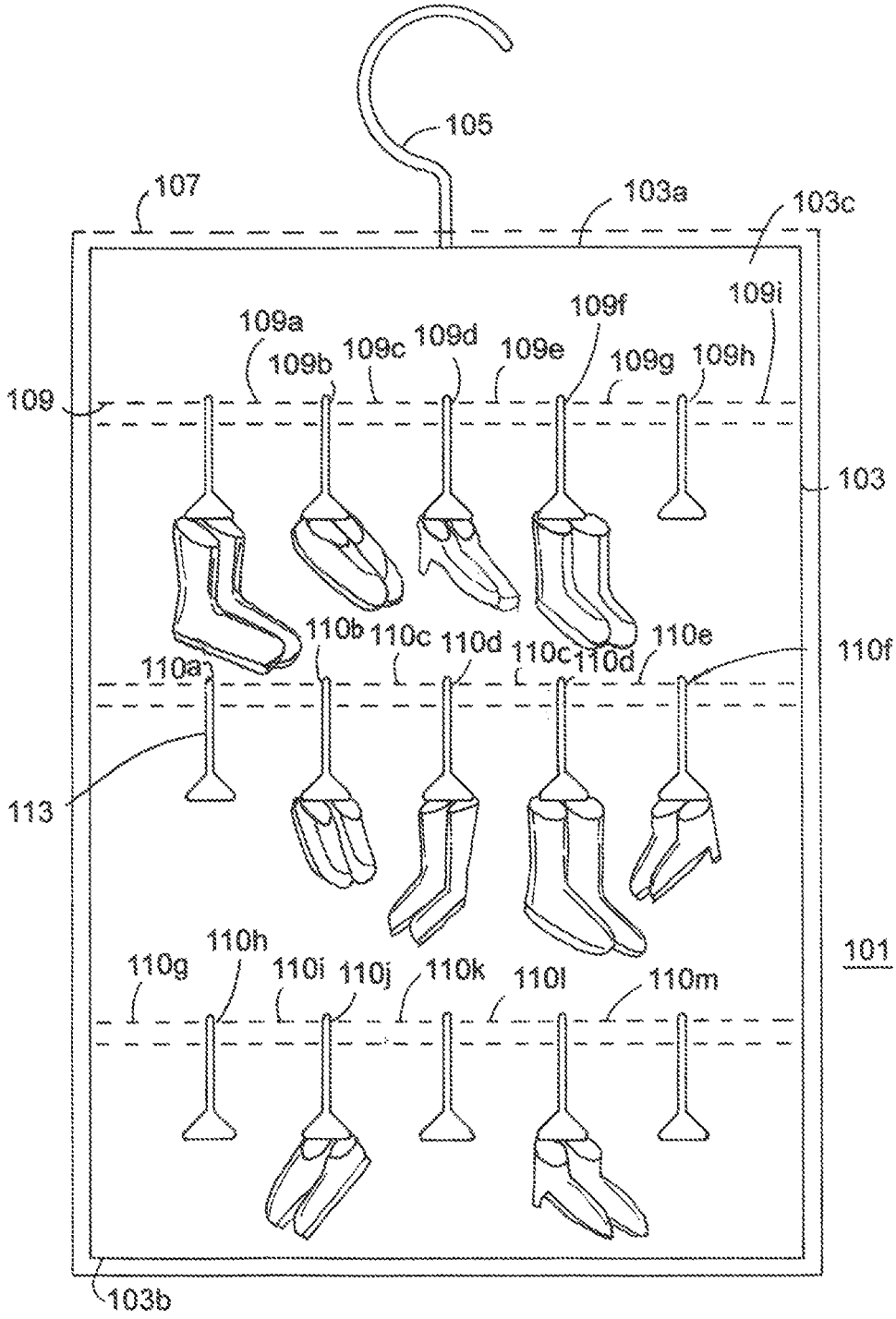
FIG. 1 is a front view of a shoe hanging rack system in accordance with the invention.

FIG. 1 shows the front view of a shoe hanging rack system 101. The shoe hanging rack system 101 includes: a frame 103, a supporting holder 105, a cover 107, a spine 109 and a holding device 113. The frame 103 may be made of plastic, wood or metal (such as steel, aluminum or copper) and it may have any shape such as a rectangle, circle, trapezoid, triangle or any shape desired by the user. Also, the frame 103 may have any dimension, such as a length of 3-6 feet and a width of 2-4 feet. Frame 103 has an inner frame 103*c*, where the inner frame 103*c* is cloth sewn around the inner frame 103*c*. Inner frame 103*c* may be made of metal or a sturdy plastic. Supporting holder 105 may be a typical hook used on a hanger or it may have any shape that is able to rest on a typical closet hanging rod.

The cover 107 is closely wrapped and/or stitched around the frame 103 so the cover 107 encapsulates the entire frame 103 of the shoe hanging rack system 101 from the top of the frame 103*a* to the bottom of the frame 103*b*. The cover 107 may be made of any type of cloth material, such as cotton, lycra, silk, leather etc. Cover 107 is a protective material that protects the shoe from coming in contact with the frame 103 so that the pair of shoes or shoe doesn't get damaged in any way by the frame 103. The cover 107 is firmly attached to a plurality of spines 109. Spines 109 are cloths, such as a sturdy cotton blend or any type of material that is sewn into cover 107. As an example, a plurality of spines 109 includes spines 109*a*, 109*b*, 109*c*, 109*d*, 109*e*, 109*f*, 109*g*, 109*h*, 109*i*, 110*a*, 110*b*, 110*c*, 110*d*, 110*e*, 110*f*, 110*g*, 110*h*, 110*i*, 110*j*, 110*k*, 110*l* and 110*m*, which may be separated from each other by 1-3 centimeters or any distance as shown in FIG. 1. Each of the aforementioned spines 109 have a corresponding stitching area where the spines are sewn onto the cover 107.

Figure 2A:
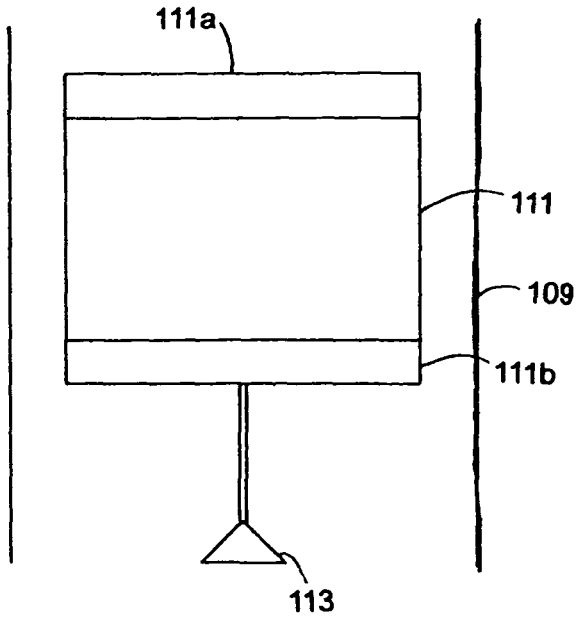
FIG. 2A illustrates the holding device of the shoe hanging rack system of FIG. 1 in accordance with the invention.
Figure 2B:
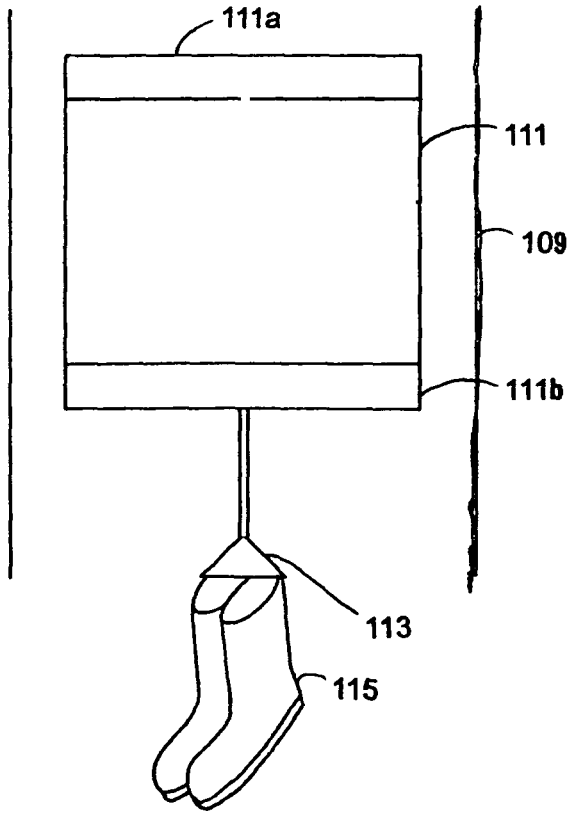
FIG. 2B shows a boot attached to the holding device of the shoe hanging rack system of FIG. 1 in accordance with the invention.

Referring to FIG. 2A, each spine 109 include a flap 111 sewn into the spine 109 where each spine 109 has a top portion 111*a* and a bottom portion 111*b*. For the flap 111 to be attached to the spine 109 to hold the holding device 113 firm reinforced stitching is applied. The spine 109 is capable of supporting 10 or more pounds. The bottom portion 111*b* includes a holding device 113. Holding device 113 may be a typical clamp or clamp attachment with two or more prongs that is able to hold any type of shoes, such as boots, sneakers, etc as shown in FIG. 1. Specifically, the prongs of the holding device 113 holds the top portion of a pair of shoes. As shown in FIG. 2B, the holding device 113 or typical clamp 113 uses its prong to secure a boot 115 or a plurality of boots 115 to it. When the holding device 113 is being utilized the prongs of the clamp 113 opens up to receive a top portion of a typical woman's pair of boots 115 or boot 115. After the pair of boots 115 are fully received within the clamp 113, then the clamp 113 is retracted or closed. The clamp 113 may have two or more prongs that close to securely hold the top portion of the boots 115.

Figure 3:
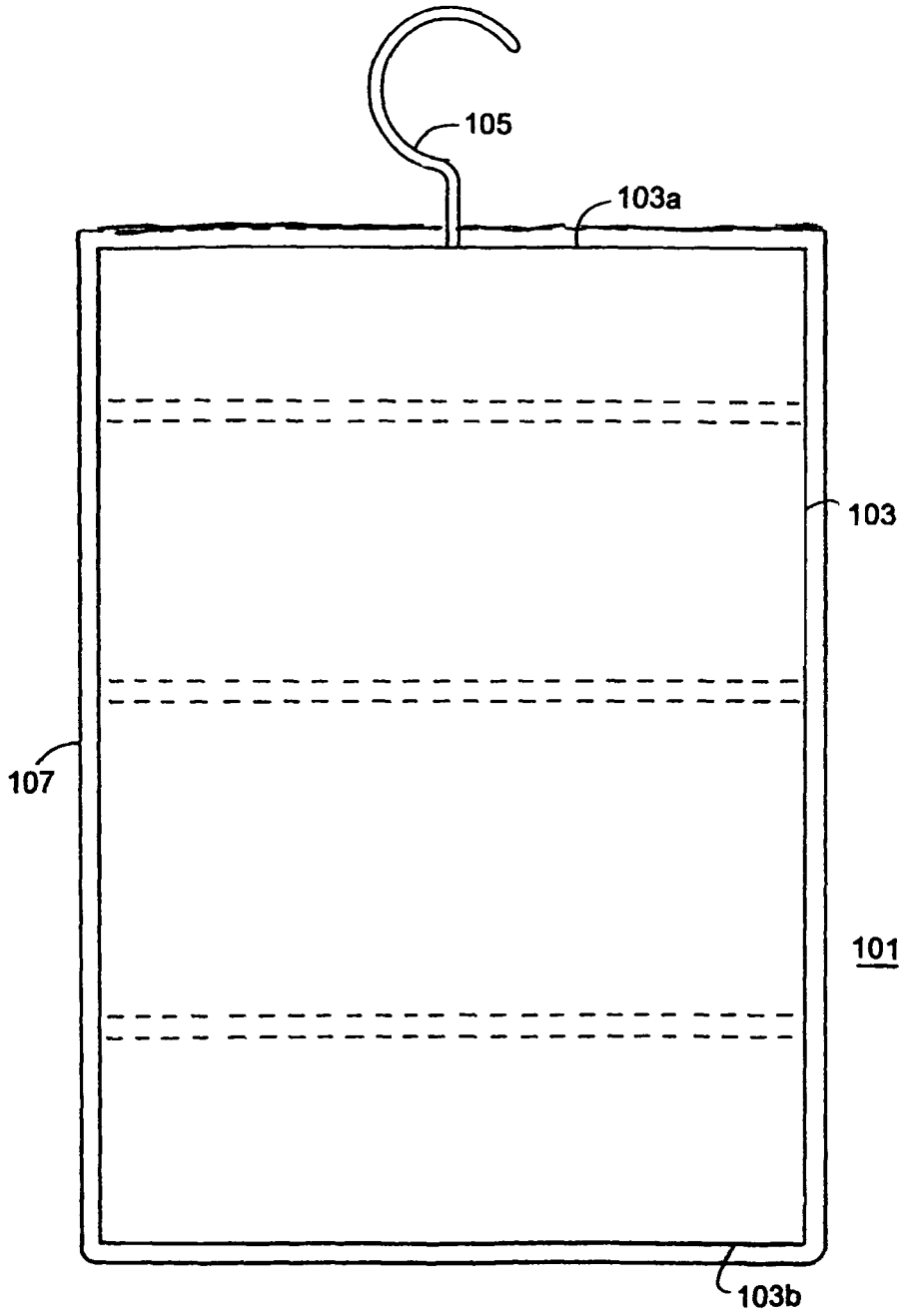
FIG. 3 is a back view of the shoe hanging rack system of FIG. 1 in accordance with the invention.
Figure 4:
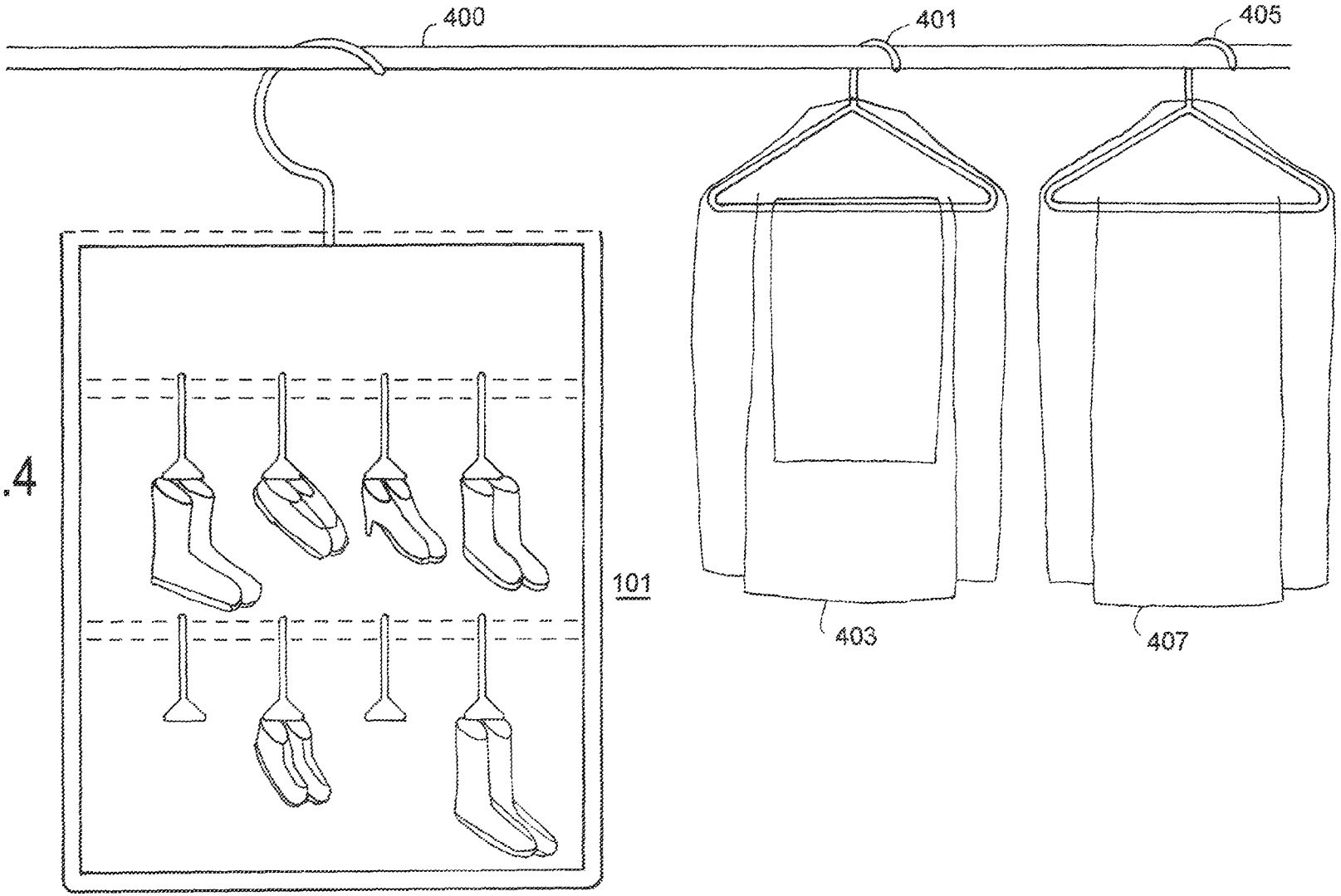
FIG. 4 shows the front view of the shoe hanging rack system of FIG. 1 on a typical clothes hanging rod in a closet in accordance with the invention.

FIG. 3 shows a back view of the shoe racking system 101. The cover 107 encapsulates also the back frame 103*c* from the top portion frame 103*a* to the bottom portion 103*b* of the frame 103. FIG. 4 is a front view of the shoe hanging rack system 101 on a typical closet hanging bar 400. The typical closet hanging bar 400 is able to hold a plurality of garments each with a hanger. Next to the shoe hanging rock system 101 is a typical hanger 401 with a suit garment 403 and another typical hanger 405 with a long sleeved shirt 407.

Figure 5:
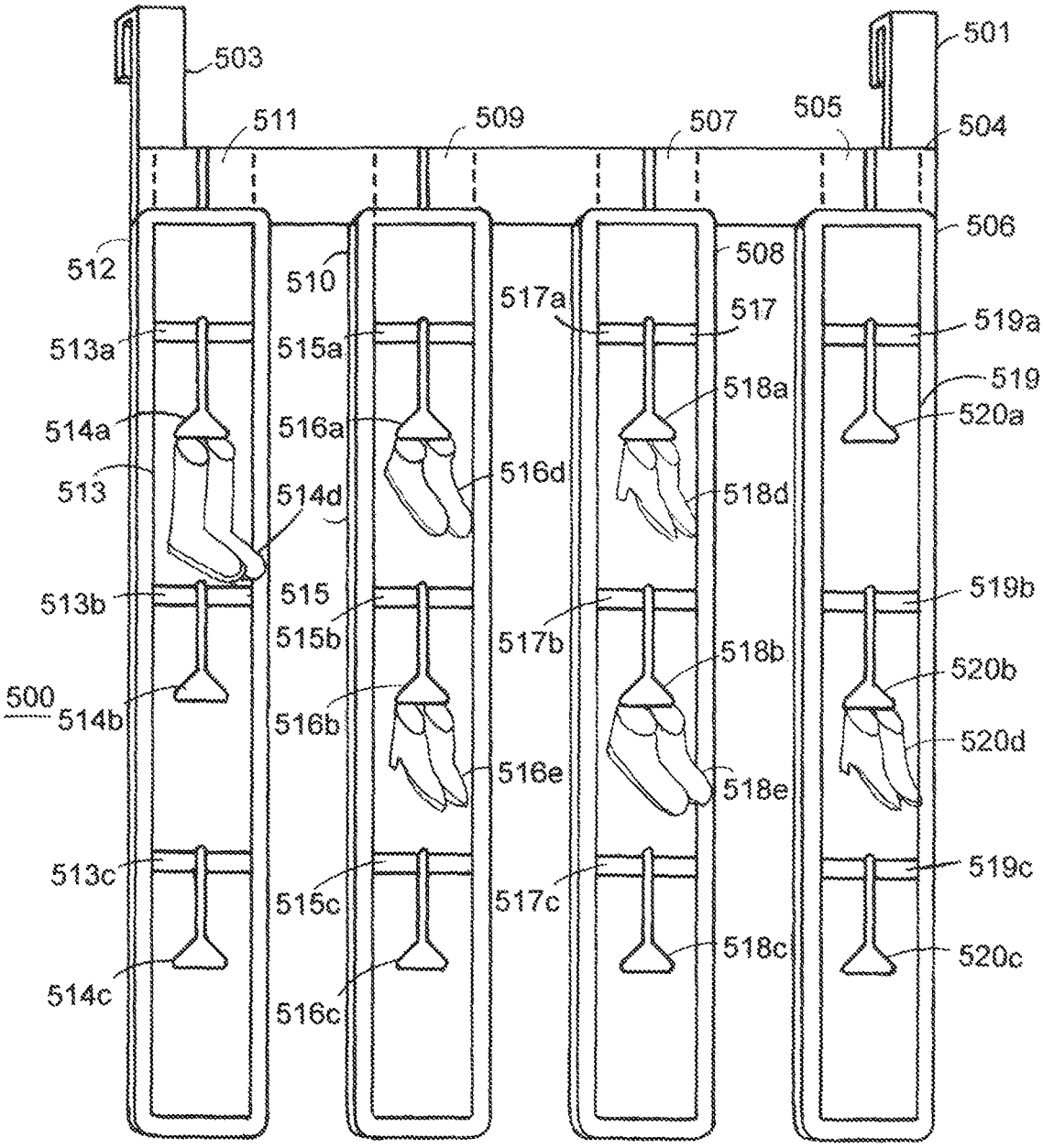
FIG. 5 is another embodiment of a shoe hanging rack system in accordance with the invention.
Figure 7:
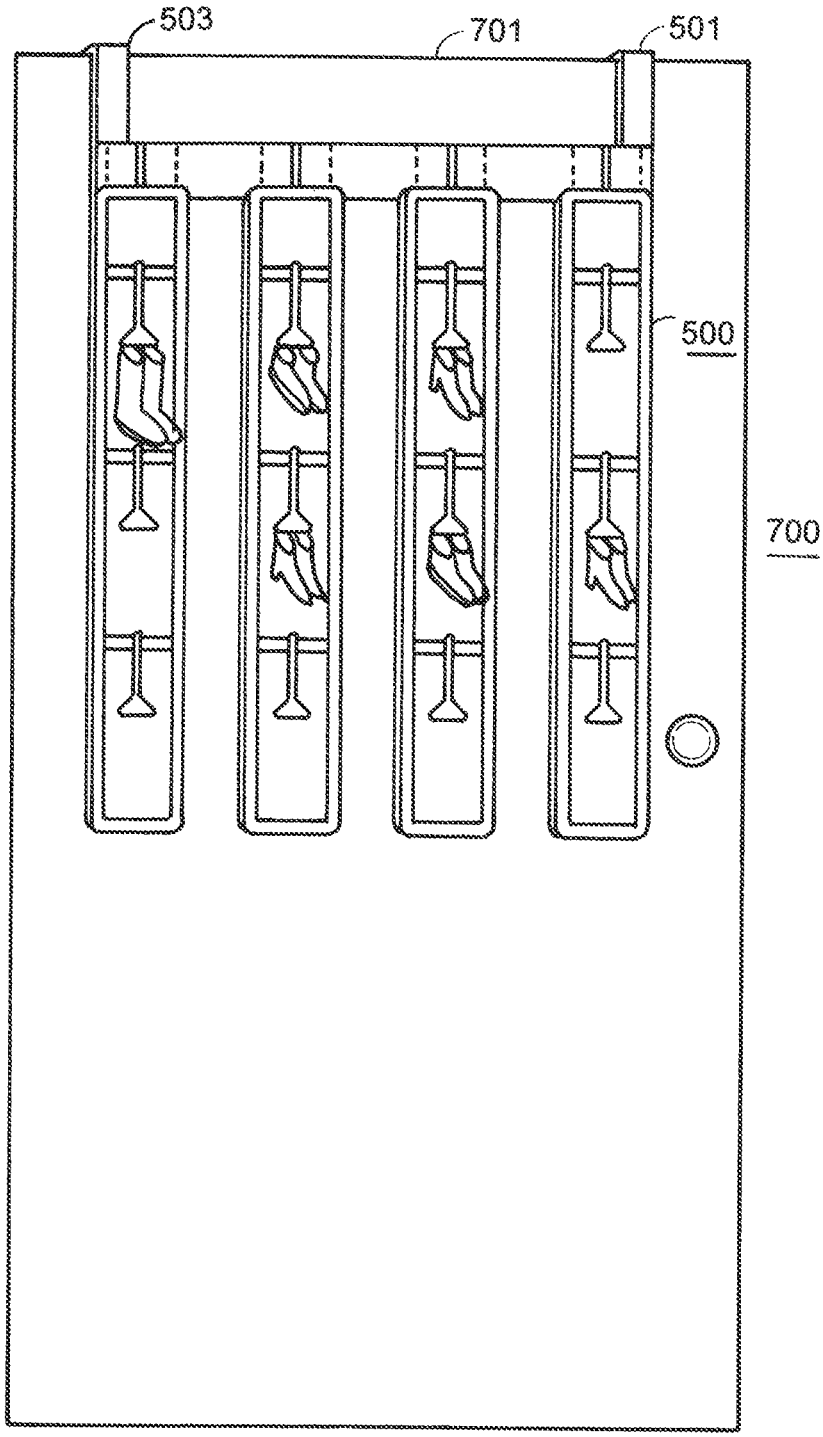
FIG. 7 shows the shoe hanging rack system of FIG. 5 in accordance with the invention attached to a typical door.

FIG. 5 is another embodiment of a shoe hanging rack system 500. Shoe hanging rack system 500 includes a first holder 501, a second holder 503, a frame 504, stitching area 505, cover 506, stitching area 507, cover 508, stitching area 509, cover 510, stitching area 511, cover 512, spine 513, spine 515, spine 517 and spine 519. The first holder 501 and the second holder 503 may be hooks or any type of holder device or device capable of holding an object that may be made of plastic, wood or metal or any type of material that can be securely placed on a top portion 701 of a typical door 700 as shown in FIG. 7. First holder 501 and second holder 503 are flat, light-weight metal welded together to form a frame that offers support that hangs over the door 700.

Referring to FIG. 5, the frame 504 may be made of plastic, wood or metal (such as steel, aluminum or copper) or any material that is capable of holding shoes or any other objects for an extended period of time. Frame 504 includes stitching area 505, stitching area 507, stitching area 509 and stitching area 511 that is sewn into the frame 504. The frame 504 is connected to spine 513, spine 515, spine 517 and spine 519 by corresponding stitching area 511, stitching area 509, stitching area 507 and stitching area 505. The stitching areas 505, 507, 509 and 511 have a rectangular pattern, but it may have a circular, triangular, oval or any type of stitching area pattern that may be desired. Each of the stitching areas 505, 507, 509 and 511 has a corresponding spine 519, 517, 515 and 513. Even though the shoe hanging rack system 500 includes spines 513, 515, 517 and 519 the number of spines may be changed to 2 spines to 100 spines or more or just 1 spine stitched onto the metal frame 504. Covers 506, 508, 510 and 512 each encapsulates and is sewn around corresponding spines 519, 517, 515 and 513. The covers 506, 508, 510 and 512 are equivalent to cover 107 discussed above so a description will not be disclosed herein.

Spine 513 includes flap 513*a*, flap 513*b* and flap 513*c* where each of the flaps are sewn into the spine 513. Flaps 513*a*, 513*b* and 513*c* each include a top portion and bottom portion where the bottom portion is attached to respective holding devices 514*a*, 514*b* and 514*c* capable of holding a pair of shoes or shoe 514*d* equivalent to the flaps and holding devices of FIG. 2A so a description will not be included herein.

Spine 515 includes a flap 515*a*, flap 515*b* and flap 515*c* where each of the flaps are sewn into the spine 515. Flaps 515*a*, 515*b* and 515*c* each include a top portion and bottom portion where the bottom portion is attached to respective holding devices 516*a*, 516*b* and 516*c* capable of holding a pair of shoes or shoe 516*d* and 516*e* equivalent to the flaps and holding devices of FIG. 2A so a description will not be included herein.

Figure 6:
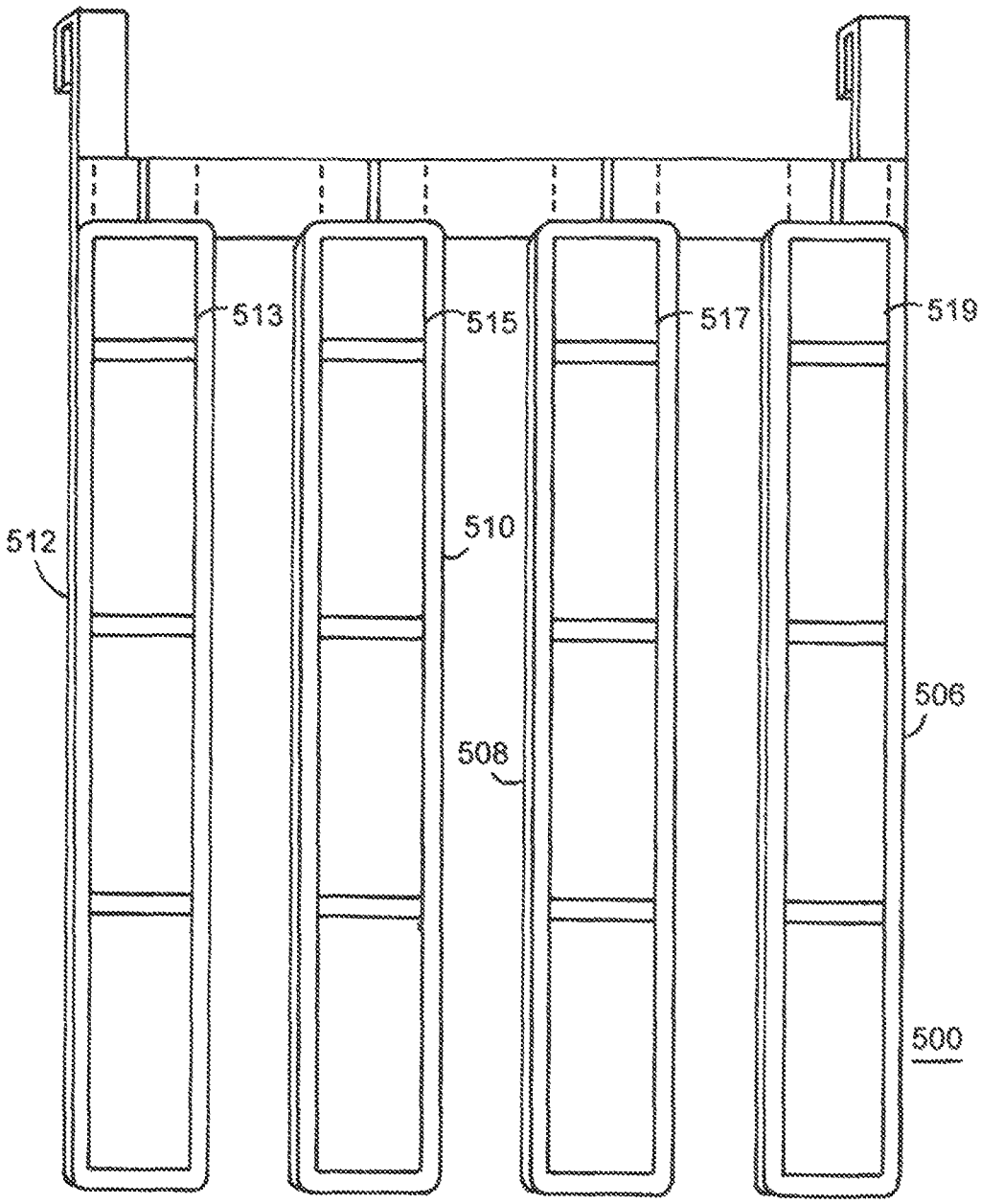
FIG. 6 is a back view of the shoe hanging rack system of FIG. 5 in accordance with the invention.

Spine 517 includes a flap 517*a*, flap 517*b* and flap 517*c* where each of the flaps are sewn into the spine 517. Flaps 517*a*, 517*b* and 517*c* each include a top portion and bottom portion where the bottom portion is attached to respective holding devices 518*a*, 518*b* and 518*c* capable of holding a pair of shoes or shoe 518*d* and 518*e* equivalent to the flaps and holding devices of FIG. 2A so a description will not be included herein. FIG. 6 shows a back view of the other embodiment of the shoe hanging rack system.

Spine 519 includes a flap 519*a*, flap 519*b* and flap 519*c* where each of the flaps are sewn into the spine 519. Flaps 519*a*, 519*b* and 519*c* each include a top portion and bottom portion where the bottom portion is attached to respective holding devices 520*a*, to 520*b* and 520*c* capable of holding a pair of shoes or shoe 520*d* equivalent to the flaps and holding devices of FIG. 2A so a description will not be included herein. FIG. 6 shows a back view of the other embodiment of the shoe hanging rack system. The back view of the shoe hanging rack system 500 shows cover 506, cover 508, cover 510 and cover 512 that encapsulates spine 519, spine 517, spine 515 and spine 513.

FIG. 7 shows the shoe hanging rack system 500 hanging from a top portion 701 of a typical door. As the shoe hanging rack system 500 hangs from the top portion 701 of the door 700, the shoe hanging rack system 500 remains stable as the holder 501 and holder 503 is securely placed on the top portion 701 of the door 700 so the hanging rack system 500 will not move.

Figure 8:
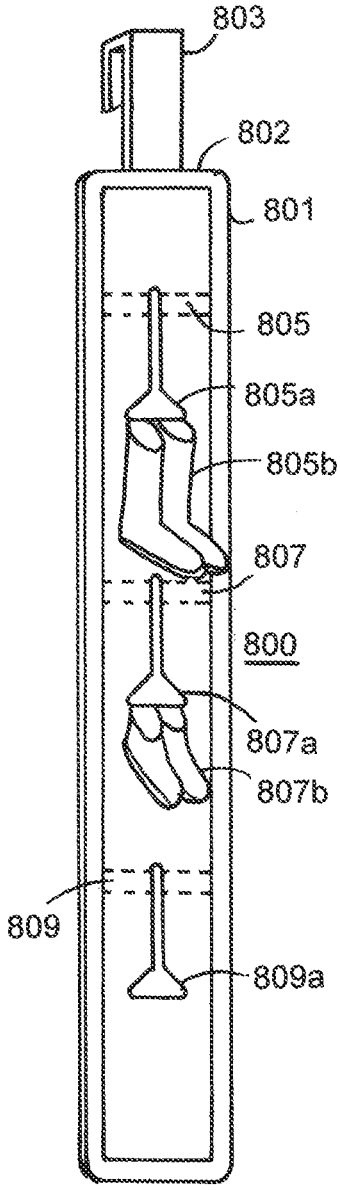
FIG. 8 is another embodiment of a shoe hanging rack in accordance with the invention.
Figure 9:
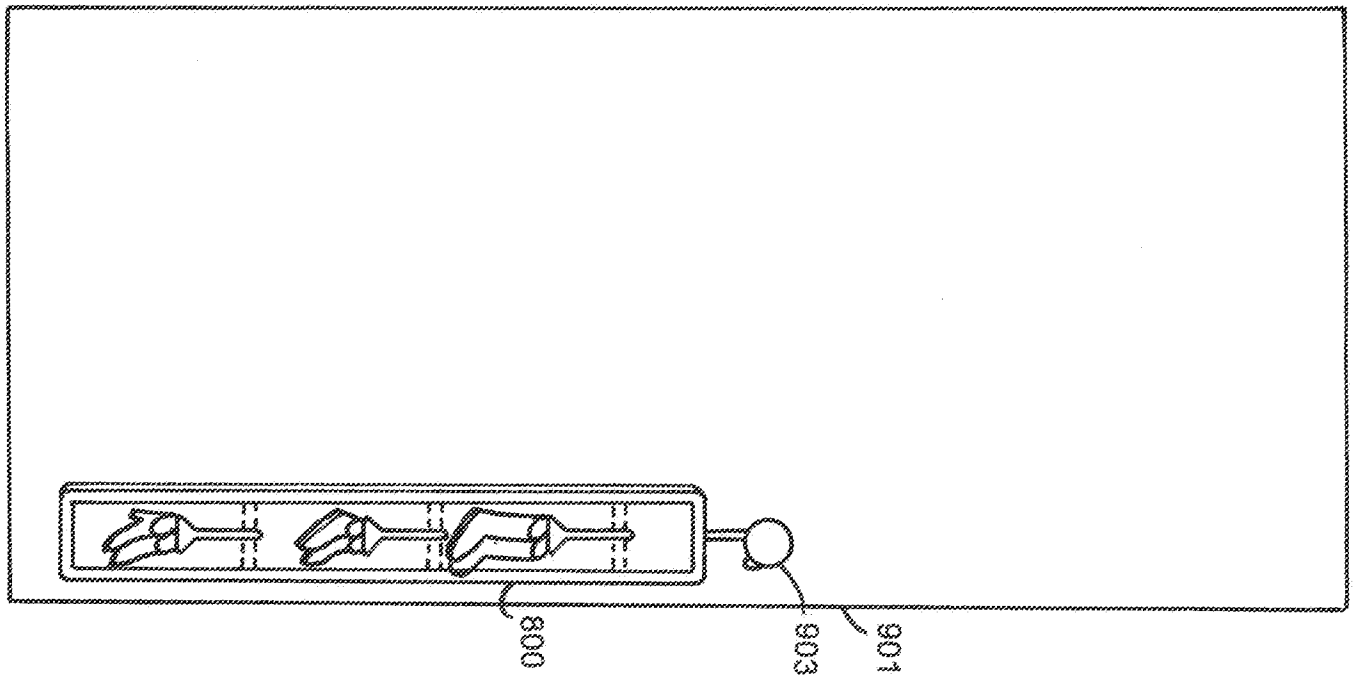
FIG. 9 is the shoe hanging rack of FIG. 8 attached to a door knob in accordance with the invention.

FIG. 8 illustrates another embodiment of a shoe hanging rack system 800. Shoe hanging rack system 800 includes a frame 801, a cover 802, a supporter holder 803, a spine 805, spine 807 and spine 809. Frame 801 may be made of plastic, wood or metal (such as steel, aluminum or copper) or any material that is capable of holding shoes or any other objects for an extended period of time. Cover 802 is equivalent to cover 107 discussed above so a description will not be included herein. The cover 802 encapsulates the frame 801 of the shoe hanging rack system 800. Supporting holder 803 may be a hook or any type of device that may be made of plastic, wood, metal or any type of material that can be securely placed on a door knob 903 of a typical door 901 as shown in FIG. 9.

Referring to FIG. 8, supporting holder 803 is a flat, light-weight metal welded to the frame 801 that offers support and hangs onto a standard door knob 903. Spine 805 includes a flap that have a top portion and a bottom portion, where the bottom portion is attached to respective holding device 805*a* equivalent to the flaps and holding device of FIG. 2A so a description will not be included herein. Holding device 805 utilizes a clamp with one or more prongs that open up to receive a pair of boots 805*b* to receive it into the clamp 805*d* then the clamp 805 closes to hold a pair of boots 805*b* in place.

Spine 807 includes a flap that has a top portion and a bottom portion, where the bottom portion is attached to respective holding device 807*a* equivalent to the flaps and holding device of FIG. 2A so a description will not be included herein. Holding device 807 utilizes a clamp with one or more prongs that open up to receive a pair of shoes 807*b* to receive it into the clamp 807, then the clamp 807 closes to hold a pair of shoes 807*b* in place.

Spine 809 includes a flap that have a top portion and a bottom portion, where the bottom portion is attached to respective holding device 809*a* equivalent to the flaps and holding device of FIG. 2A so a description will not be included herein. Even though there are only three spines on this shoe hanging rack system 800 there may be 1 to 100 or more spines and/or 1 to 100 or more holding devices.

This invention provides a shoe hanging rack system that allows a user to have an accessible system for hanging up and accessing her shoes. The shoe hanging rack system has a cover that protects the shoe from being altered or damaged in any way when it is on the shoe hanging rack system. In addition, the user is able to utilize the prong system to easily put any type of shoes onto the shoe hanging rack system. Further, the user is able to readily remove her shoe from the hanging rack system by simply opening the holding device that releases the shoe. Thus, this invention provides the user with a means to easily store her shoes, protect it from damage and easily access her shoes.

What is claimed is:

1. A shoe hanging system, the system comprising:

a rigid frame, wherein the rigid frame has a top portion and bottom portion wherein a cover is wrapped around the top portion of the rigid frame to the bottom portion of the rigid frame;

the rigid frame includes an inner frame that extends from the top portion of the rigid frame to the bottom portion of the rigid frame, wherein a cloth surrounds the inner frame;

a plurality of spines are attached along the cover of the rigid frame, wherein the plurality of spines are sewn onto the cover of the rigid frame wherein the plurality of spines are placed in a horizontal position along the cover;

wherein each of the plurality of spines are separated from each other; and wherein each of the plurality of spines are attached to at least one holding device, wherein the at least one holding device is configured to secure at least one shoe.

2. The shoe hanging system of claim 1, wherein the at least one shoe is a boot.

3. The shoe hanging system of claim 1, wherein the at least one shoe is a sneaker.

4. The shoe hanging system of claim 1, wherein the frame is made of metal.

5. The shoe hanging system of claim 1, wherein a supporting holder is attached to the frame.

6. The shoe hanging system of claim 5, wherein the supporting holder is a hook.

7. The shoe hanging system of claim 1, wherein each of the plurality of holding devices is a metal clamp.

8. The shoe hanging system of claim 7, wherein the metal clamp includes prongs.

9. The shoe hanging system of claim 1 wherein the plurality of spines are made of a sturdy cotton blended material.

10. A system for hanging shoes, the system comprising:

a first holder and a second holder are coupled to a horizontal rigid frame;

the horizontal rigid frame is coupled to a plurality of vertical stitching areas, wherein each of the plurality of vertical stitching areas are separated from each other;

the plurality of vertical stitching areas each have a top portion and a bottom portion, wherein the top and bottom portion of each of the plurality of vertical stitching areas are covered;

a plurality of spines are sewn onto the covered top and bottom portion of the plurality of vertical stitching areas; and each of the plurality of spines are configured to hold at least one shoe.

* * * * *